US005512414A

United States Patent [19]

Texter

[11] Patent Number: 5,512,414

[45] Date of Patent: Apr. 30, 1996

[54] SOLID PARTICLE COUPLER DISPERSIONS FOR COLOR DIFFUSION TRANSFER ELEMENTS

[75] Inventor: John Texter, Rochester, N.Y.

[73] Assignee: Eastman Kodak Company, Rochester, N.Y.

[21] Appl. No.: 125,990

[22] Filed: Sep. 23, 1993

[51] Int. Cl.[6] ..... G03C 7/388; G03C 8/10; G03C 8/52

[52] U.S. Cl. ..... 430/213; 430/212; 430/214; 430/222; 430/223; 430/224; 430/225; 430/226; 430/237; 430/546

[58] Field of Search ..... 430/212, 214, 430/237, 546, 222, 223, 224, 225, 226, 213

[56] References Cited

U.S. PATENT DOCUMENTS

| | | | |
|---|---|---|---|
| 3,676,147 | 7/1972 | Boyer et al. | 96/130 |
| 3,832,173 | 8/1974 | Cerankowski et al. | 430/222 |
| 3,888,669 | 6/1975 | Cardone | 430/214 |
| 4,006,025 | 2/1977 | Swank et al. | 430/570 |
| 4,401,746 | 8/1983 | Pfingston | 430/215 |
| 4,407,929 | 10/1983 | Bole et al. | 430/212 |
| 4,429,033 | 1/1984 | Boie et al. | 430/214 |
| 4,474,872 | 10/1984 | Onishi et al. | 430/546 |
| 4,485,165 | 11/1984 | Finn et al. | 430/220 |
| 4,508,809 | 4/1985 | Boie et al. | 430/220 |
| 4,927,744 | 5/1990 | Henzel et al. | 430/214 |
| 4,948,718 | 8/1990 | Factor et al. | 430/522 |
| 5,112,720 | 5/1992 | Karino | 430/214 |
| 5,240,821 | 8/1993 | Texter et al. | 430/546 |
| 5,274,109 | 12/1993 | Texter | 430/522 |
| 5,288,745 | 2/1994 | Texter et al. | 430/214 |
| 5,300,394 | 4/1994 | Miller et al. | 430/551 |

FOREIGN PATENT DOCUMENTS

| | | |
|---|---|---|
| 1105761 | 7/1981 | Canada . |
| 62-136645 | 6/1987 | Japan . |
| 4-73751 | 3/1992 | Japan . |

*Primary Examiner*—Richard L. Schilling
*Attorney, Agent, or Firm*—Paul A. Leipold

[57] ABSTRACT

A photographic color diffusion transfer element is disclosed wherein said element comprises a single dimensionally stable support, wherein said support comprises an opaque and light reflecting layer, and coated thereon in reactive association and in sequence (1) a mordant layer for binding diffusible dyes, (2) a stripping layer, (3) one or more layers comprising radiation sensitive silver halide, a solid particle dispersion of a diffusible-dye forming compound, or radiation sensitive silver halide and a solid particle dispersion of a diffusible-dye forming compound, and (4) a barrier layer comprising a polymer that (a) allows the passage of solutions for processing said element when said element is contacted with an external processing bath and (b) blocks the diffusion out of said element of the diffusible dye formed from said solid particle dispersion of a diffusible-dye forming compound when said element is contacted with an external processing bath. A further embodiment of a photographic color diffusion transfer element is disclosed wherein said element comprises a single dimensionally stable transparent support, and coated thereon in reactive association and in sequence (1) a mordant layer for binding diffusible dyes, (2) an opacifying light reflecting layer, (3) one or more layers comprising radiation sensitive silver halide, a solid particle dispersion of a diffusible-dye forming compound, or radiation sensitive silver halide and a solid particle dispersion of a diffusible-dye forming compound, and (4) a barrier layer comprising a polymer that (a) allows the passage of solutions for processing said element when said element is contacted with an external processing bath and (b) blocks the diffusion out of said element of the diffusible dye formed from said solid particle dispersion of a diffusible-dye forming compound when said element is contacted with an external processing bath. In addition, another embodiment of a photographic color diffusion transfer element is disclosed wherein said element comprises a single dimensionally stable transparent support, and coated thereon in reactive association and in sequence (1) one or more layers comprising radiation sensitive silver halide, a solid particle dispersion of a diffusible-dye forming compound, or radiation sensitive silver halide and a solid particle dispersion of a diffusible-dye forming compound, (2) an pacifying light reflecting layer, (3) a mordant layer for binding diffusible dyes, and (4) a barrier layer comprising a polymer that (a) allows the passage of solutions for processing said element when said element is contacted with an external processing bath and (b) blocks the diffusion out of said element of the diffusible dye formed from said solid particle dispersion of a diffusible-dye forming compound when said element is contacted with an external processing bath.

28 Claims, No Drawings

SOLID PARTICLE COUPLER DISPERSIONS FOR COLOR DIFFUSION TRANSFER ELEMENTS

RELATED APPLICATIONS

This application is related to copending and commonly assigned U.S. application Ser. No. 07/952,447 (Polymeric Barrier Layer for Diffusible-Dye Containment in Photographic Elements of Texter et al. filed Sep. 28, 1992), U.S. application Ser. No. 07/952,443 (Image Separation System for Large Volume Development of Texter et al. filed Sep. 28, 1992), U.S. application Ser. No. 07/952,556 (Integral Color Diffusion Transfer Element for Large Volume Development of Texter et al. filed Sep. 28, 1992), U.S. application Ser. No. 07/952,444 (Dye Releasing Couplers for Color Diffusion Transfer Element of Welter and Texter filed Sep. 28, 1992), and U.S. application Ser. No. 07/956,140 (Reactivity Control in Microcrystalline Coupler Dispersions of Texter filed Oct. 5, 1992).

FIELD OF THE INVENTION

This invention relates to photographic imaging systems that utilize silver halide based radiation sensitive layers and associated formation of image dyes in an aqueous and large-volume development process and to systems which utilize polymeric barrier layers to control diffusion of particular components. In particular, this invention relates to such systems where the resulting dyes, when the photographic elements are substantially wet, have substantial solubility and freedom to diffuse.

BACKGROUND OF THE INVENTION

Conventional Wet Silver Halide Processes

In conventional aqueous processing of silver halide based color photographic elements, an imagewise exposed element, for example color paper designed to provide color prints, is processed in a large volume of color developer solution. The element is typically immersed in a deep tank of aqueous processing solution wherein the volume of solution is much greater than the volume of the element therein immersed and wherein the volume of solution is much greater than the swollen volume of the light sensitive emulsion layers coated upon the photographic element. The developer typically reduces the exposed silver halide of the element to metallic silver and the resulting oxidized color developer reacts with incorporated dye-forming couplers to yield dye images corresponding to the imagewise exposure. Since silver is generally gray and desaturates the pure colors of the dyes, it is desirable to remove it from the dye images. Silver is conventionally separated from the dye images by a process of bleaching the silver to a silver halide and removing the silver halide by using a fixing bath. This fixing bath also removes the undeveloped silver halide. Commonly, the bleach and fix are combined into one solution, a bleach-fix solution.

Color Diffusion Transfer Systems

Diffusion transfer processes in photography are well known. Cieciuch et at., in U.S. Pat. Nos. 3,719,489 and 4,060,417, describe photographic processes employing certain compounds which are stable in photographic processing composition but capable of undergoing cleavage in the presence of an imagewise distribution of silver ions created during processing of a silver halide emulsion to liberate a photographically active reagent or a dye in an imagewise distribution corresponding to that of said silver ions. Depending on the photographic process and the result it is desired to achieve the inert parent compound may be diffusible or substantially nondiffusible in the processing solution and the reagent liberated also may be diffusible or substantially nondiffusible in the processing composition.

Land, in U.S. Pat. No. 3,615,421, Taylor, in U.S. Pat. No. 4,202,694, and Murphy, in U.S. Pat. No. 4,680,247, disclose laminated multilayer diffusion transfer film units that comprise two supports (forming the outer surfaces of the respective units). One of said supports is a transparent support (through which the final color dye image is observed, and the other of said supports is usually an opaque support or a transparent support with an adjacent opaque layer. Processing fluids in such film units are dispersed from rupturable pods between various layers inside said units.

Pfingston, in U.S. Pat. No. 4,401,746, discloses a diffusion transfer element comprising in order a topcoat protective layer, light-sensitive and dye providing layers, a stripping layer, a dyeable stratum, and a support. The processing composition may be applied to the exposed photosensitive element by dipping. The developing agent may be any of those commonly employed. The dyeable stratum together with any other image-receiving components are separable from the photosensitive component using the stripping layer.

Boie et al., in U.S. Pat. No. 4,429,033, disclose a process for color print production by diffusion transfer, wherein the diffusion transfer element comprises, in order, a transparent layer support, a light-sensitive element comprising silver halide and a non-diffusing color-providing compound, a light-reflecting opaque layer, and a mordant layer. After development, silver and silver halide are removed by bleaching and fixing.

Boie et al., in U.S. Pat. No. 4,508,809, disclose a process and apparatus for exposing and developing photographic images in a diffusion transfer elements. Said element comprises a monosheet material containing a layer which is impermeable to light but permeable to moisture. Said layer divides said element into a photosensitive side for imagewise exposure and a non-photosensitive side for observation and supplying of activator or developer solution. The photosensitive side of said element is exposed image-wise in the dark and then sealed in said apparatus in a light-proof manner, whereby the non-photosensitive side of the element lies open and is exposed to an activator to develop the image. Said exposure to activator may be done in daylight, and once the image quality has been achieved, development is stopped by removal of activator, rinsing, and drying the element in the conventional manner.

Finn and DeBoer, in U.S. Pat. No. 4,485,165, disclose diffusion transfer elements for producing monochromatic dye images comprising (1) a support having thereon a layer of nondiffusible dye image-providing material, a stripping layer, an opaque layer, and a silver halide emulsion layer; (2) a transparent cover sheet; and (3) an opaque processing composition for application between the element and cover sheet. A dye mordant layer may also be present on the element or cover sheet. After exposure and processing, the layer of nondiffusible dye image-providing material on a support is snipped away to provide a monochromatic retained dye image without the need for bleaching and fixing.

Karino, in U.S. Pat. No. 5,112,720, discloses a color diffusion transfer film unit comprising (1) a support having a light-shielding function in itself and/or having thereon a layer having a light-shielding function; (2) a light sensitive element on the support comprising, in order from the support at least (a) a color image receiving layer, (b) a peeling layer, and (c) at least one silver halide emulsion layer associated with a color image-forming substance; (3) a light-shielding agent containing alkali processing composition; and (4) a cover sheet comprising at least a layer having a neutralizing function on a transparent support, wherein said cover sheet is characterized by having a dye-trapping layer comprising a mordant in a binder adjacent to the alkali processing composition.

Diffusible Dye Releasing Couplers

Dappen and Smith in U.S. Pat. No. 3,743,504 disclose the use of immobile diffusible-dye-forming couplers and immobile diffusible-dye-releasing couplers in a color diffusion transfer system. Minagawa, Arai, and Ueda in U.S. Pat. 4,141,730 disclose the use of immobile colored coupling compounds which release diffusible dye during color development. These compounds are used to advantage in masking applications. Lau, in U.S. Pat. No. 4,248,962, discloses dye releasing couplers wherein dyes are anchimerically released by coupling-off groups subsequent to reaction of oxidized aromatic amine developers with said couplers. Sakanoue, Hirano, Adachi, Minami, and Kanagawa in Geman Offen. No. 3,324,533 A1, Booms and Holstead in U.S. Pat. No. 4,420,556, and Arakawa and Watanabe in European Patent Specification 115,303 B1 disclose the use of diffusible dye forming couplers to provide photographic materials with improved graininess. Mooberry and Singer, in U.S. Pat. No. 4,840,884, disclose dye-releasing couplers that release electrically neutral dyes and wherein said dyes are released from a coupling-off group comprising a dye and a divalent linking group of the formula —L—NR—, wherein L is a divalent linking group and NR is a substituted nitrogen atom.

Solid Particle Dispersion Technology

Langen et at., in U.K. Pat. No. 1,570,362 disclose the use of solid particle milling methods such as sand milling, bead milling, dyno milling, and related media, ball, and roller milling methods for the production of solid particle dispersions of photographic additives such as couplers, UV-absorbers, UV stabilizers, white toners, stabilizers, and sensitizing dyes.

Henzel and Zengerle, in U.S. Pat. No. 4,927,744, disclose photographic elements comprising solid particle dispersions of oxidized developer scavengers. Said dispersions are prepared by precipitation and by milling techniques such as ball-milling.

Boyer and Caridi, in U.S. Pat. No. 3,676,147, disclose a method of ball-milling sensitizing dyes in organic liquids as a means of spectrally sensitizing silver halide emulsions. Langen et at., in Canadian Patent No. 1,105,761, disclose the use of solid particle milling methods and processes for the introduction of sensitizing dyes and stabilizers in aqueous silver salt emulsions.

Swank and Waack, in U.S. Pat. No. 4,006,025, disclose a process for dispersing sensitizing dyes, wherein said process comprises the steps of mixing the dye particles with water to form a slurry and then milling said slurry at an elevated temperature in the presence of a surfactant to form finely divided particles. Onishi et al., in U.S. Pat. No. 4,474,872, disclose a mechanical grinding method for dispersing certain sensitizing dyes in water without the aid of a dispersing agent or wetting agent. This method relies on pH control in the range of 6–9 and temperature control in the range of 60°–80° C.

Factor and Diehl, in U.S. Pat. No. 4,948,718, disclose solid particle dispersions of dyes for use as filter dyes in photographic elements. They disclose that such dyes can be dispersed as solid particle dispersions by precipitating or reprecipitating (solvent or pH shifting), by ball-milling, by sand-milling, or by colloid-milling in the presence of a dispersing agent.

Barrier Layers

Cardone, in U.S. Pat. No. 3,888,669, discloses the use of barrier layers in multilayer and multicolor composite diffusion transfer film units. Said diffusion transfer film units comprise diffusible dye forming layers, a dye fixing layer or a dye mordanting layer, an opaque layer or means for producing an opacifying layer, a barrier layer impermeable to the diffusible dyes produced but permeable to a contacting processing composition, a dimensionally stable transparent layer adjacent to the barrier layer, means for interposing between said barrier layer and said adjacent dimensionally stable transparent layer a processing composition, and means for maintaining the composite film unit intact subsequent to diffusion transfer processing of the unit.

The use of spacer layers or timing layers as barrier layers to delay the function of neutralizing layers in diffusion transfer processes is described in U.S. Pat. Nos. 2,584,030, 3,419,389, 3,421,893, 3,433,633, 3,455,686, 3,592,645, 3,756,815, and 3,765,893, and in *Research Disclosure*, Vol. 123, July 1974, Item No. 12331, entitled Neutralizing Materials in Photographic Elements. Specific polymeric materials which have been demonstrated to be effective as barrier layers between dye image forming units have been disclosed in U.S. Pat. Nos. 3,384,483, 3,345,163, and 3,625,685.

The use of barrier layers during development in image diffusion transfer elements, particularly integral elements, to prevent diffusion of materials to the image receiving layer has been described by Buckler et al. in U.S. Pat. No. 3,679,409. Such barrier layers allow diffusion of image forming materials or products of such materials at high pH, such as the pH of the processing composition, prevent diffusion of such materials at low pH, and thereby prevent diffusion of the image forming materials after processing. Other means for forming barrier layers are disclosed in U.S. Pat. Nos. 3,576,626 and 3,597,197.

Abel and Bowman, in U.S. Pat. No. 4,504,569, disclose a temporary barrier layer comprising N-alkyl substituted acrylamide and a polymerized crosslinking monomer wherein the polymer has a solubility parameter from 13 to 16 at 25° C. The barrier layer is useful as a process timing layer in color image transfer film units.

Bowman and Verhow, in U.S. Pat. No. 4,865,946, disclose a temporary barrier layer comprising polymerizable monomers of certain acrylamides, crosslinking groups, and other ethylenically unsaturated monomers. Said barrier layers are useful in color image transfer units.

Holmes and Campbell, in U.S. Pat. No. 4,055,429, disclose a polymeric barrier layer for scavenging diffusible dyes.

PROBLEM TO BE SOLVED BY THE INVENTION

Bleach-fix solutions commonly contain iron, ammonium, ethylenediaminetetraacetic acid, thiosulfate and, after use, silver. These components of "wet" silver halide processing are the source of much of the pollution from photofinishing processes.

Acid solubilized couplers and dye-releasing compounds that produce aqueous-alkaline diffusible dyes generally have one or more highly polar functional groups. Such compounds, because of their polarity, generally are difficult to dissolve in small quantities of low or high vapor pressure organic liquids and solvents, and are thus difficult to disperse as aqueous colloids according to homogenization and colloid milling methods commonly used in the photographic trade and in the art. Moreover, not withstanding this difficulty in solubilizing such compounds during dispersion making, when such compounds are dispersed they are in a metastable thermodynamic state and are prone to crystallization during the storage of such dispersions, during the melting and coating of photographic elements containing said compounds, and during the storage of such photographic elements. Such crystallization typically results in crystals that increase the amount of unwanted light scattering in photographic elements, and are often of sufficient size to significantly decrease the coupling or dye-releasing activity of such dispersions so that aim contrasts and Dmax cannot be achieved in the photographic element. Furthermore, when organic solvents are used to solubilize these compounds during dispersion making, these solvents are generally noxious to operators and workers effecting the dispersion making process, and it is generally desired to minimize or eliminate their use so as to minimize or eliminate the exposure of said solvents to humans in the immediate environment.

Photographic elements containing image-transfer diffusible dyes, when processed in developer baths of the type normally encountered in the photofinishing trade, suffer from a high degree of dye washout. This washout represents a major inefficiency in dye utilization, since the dye which washes out into the developer solution or other processing solution is no longer available to provide a dye image in the photographic element. Furthermore, this washout results in severe seasoning of the developer baths and in the unwanted accumulation of precipitates in low pH stop and bleaching baths. Most color diffusion transfer systems require the physical separation of donor and receiver elements during or immediately following development of the color diffusion transfer image. This separation results in the accumulation of solid waste.

These and other problems may be overcome by the practice of our invention.

SUMMARY OF THE INVENTION

It is an object of our invention to reduce the amount of waste processing solution effluents generated by the overall processing system while retaining the benefits of image quality and industry compatibility which are derived from wet development with conventional developing solutions.

An object of the present invention is to provide improved image dye retention in the photographic element and improved image dye hue in said element. Yet another object of the present invention is to minimize the seasoning of processing solutions with diffusible dyes. An additional object of the present invention is to minimize the amount of solid waste generated in the photofinishing of color print materials.

In accordance with this invention a photographic color diffusion transfer element is provided wherein said element comprises one and only one dimensionally stable support, wherein said support comprises an opaque and light reflecting layer, and coated thereon in reactive association and in sequence (1) a mordant layer for binding diffusible dyes, (2) a stripping layer, (3) one or more layers comprising radiation sensitive silver halide, a solid particle dispersion of a diffusible-dye forming compound, or radiation sensitive silver halide and a solid particle dispersion of a diffusible-dye forming compound, and (4) a barrier layer comprising a polymer that (a) allows the passage of solutions for processing said element when said element is contacted with an external processing bath and (b) blocks the diffusion out of said element of the diffusible dye formed from said solid particle dispersion of a diffusible-dye forming compound when said element is contacted with an external processing bath.

A further embodiment of a photographic color diffusion transfer element is provided wherein said element comprises one and only one dimensionally stable support, wherein said support is optically transparent, and coated thereon in reactive association and in sequence (1) a mordant layer for binding diffusible dyes, (2) an opacifying light reflecting layer, (3) one or more layers comprising radiation sensitive silver halide, a solid particle dispersion of a diffusible-dye forming compound, or radiation sensitive silver halide and a solid particle dispersion of a diffusible-dye forming compound, and (4) a barrier layer comprising a polymer that (a) allows the passage of solutions for processing said element when said element is contacted with an external processing bath and (b) blocks the diffusion out of said element of the diffusible dye formed from said solid particle dispersion of a diffusible-dye forming compound when said element is contacted with an external processing bath.

In addition, another embodiment of a photographic color diffusion transfer element is provided wherein said element comprises one and only one dimensionally stable support, wherein said support is optically transparent, and coated thereon in reactive association and in sequence (1) one or more layers comprising radiation sensitive silver halide, a solid particle dispersion of a diffusible-dye forming compound, or radiation sensitive silver halide and a solid particle dispersion of a diffusible-dye forming compound, (2) an opacifying light reflecting layer, (3) a mordant layer for binding diffusible dyes, and (4) a barrier layer comprising a polymer that (a) allows the passage of solutions for processing said element when said element is contacted with an external processing bath and (b) blocks the diffusion out of said element of the diffusible dye formed from said solid particle dispersion of a diffusible-dye forming compound when said element is contacted with an external processing bath.

ADVANTAGEOUS EFFECT OF THE INVENTION

The present invention reduces the amount of waste processing solution effluent generated by the overall processing system while retaining the benefits of image quality and industry compatibility derived from wet development with conventional developing solutions. The invention also provides improved image dye retention in the photographic elements and minimizes the seasoning of processing solutions with diffusible dyes. The invention also minimizes the amount of solid waste generated in the photo finishing of color print materials.

The present invention provides for the elimination of the use of noxious organic solvents during the dispersion making steps of dispersing the dye-releasing or dye-forming compounds. The present invention provides improved dispersions of dye-forming and dye-releasing compounds, where the tendency of unwanted large crystal formation is minimized since the compounds are dispersed as fine particle microcrystalline dispersions, wherein the driving force for recrystallization is minimized. The minimization of crystallization of the dye-forming and dye-releasing compounds afforded by the present invention provides for improved storage stability of the dispersions of these compounds and for improved storage stability of photographic elements containing solid particle dispersions of these compounds.

DETAILED DESCRIPTION OF THE INVENTION

The term "nondiffusing" used herein as applied to the couplers and diffusible-dye forming compounds has the meaning commonly applied to the term in color photography and denotes materials which for all practical purposes do not migrate or wander through organic colloid layers, such as gelatin, comprising the sensitive elements of the invention. The term "diffusible" as applied to dyes formed from these "nondiffusing" couplers and compounds in the processes has the converse meaning and denotes materials having the property of diffusing effectively through the colloid layers of the sensitive elements in the presence of the "nondiffusing" materials from which they are derived.

Solid particle coupler dispersions in this invention are dispersions of couplers wherein the particle size of the couplers is on average less than 1 μm in largest dimension and wherein the physical state of the coupler in said particles is a microcrystalline physical state.

The term microcrystalline means that long range order among the coupler molecules exists in the dispersion particles such that a sufficient number of such particles in a scattering-volume element will provide a conventional-looking powder diffraction pattern and d-spacings characteristic of small crystalline particles. Such scattering and diffraction criteria are explained and illustrated by H. P. Klug and L. E. Alexander in X-ray Diffraction Procedures (John Wiley & Sons, N.Y., 1974).

The term "barrier" used herein as applied to "barrier layers" has the meaning commonly applied to the term in color photography and denotes an impediment to the aqueous diffusion of diffusible-dye. This impediment is manifested by the reflection or deflection of diffusible dyes by said barrier layers.

Couplers

The couplers suitable for this invention may be any couplers that can be dispersed as microcrystalline solid particle dispersions in an aqueous medium. Said couplers are substantially water insoluble at the pH and temperatures of dispersion preparation and use. Typical of such compounds are most photographic color couplers, including those which contain ionizing groups of moderate $pK_a$ such as carboxyl groups and sulfonamido groups.

Couplers are usually obtained in powdered crystalline form as a natural course of their synthesis and purification. In cases where couplers are obtained in an amorphous form, crystallization can be induced by methods well known in the art, such as thermal annealing, seed crystallization, crystallization from alternative solvents, etc. The expression microcrystalline particles means that said particles are in a physical state as described above in the definition of microcrystalline, and further that said particles am smaller than 1 μm in average dimension.

Typical couplers which form cyan dyes upon reaction with oxidized color developing agents are described in such representative patents as U.S. Pat. Nos. 2,313,586, 2,367,531, 2,369,929, 2,423,730, 2,474,293, 2,772,162, 2,801,171, 2,895,826, 3,002,836, 3,034,892, 3,041,236, 3,419,390, 3,476,563, 3,476,565, 3,772,002, 3,779,763, 3,996,252, 4,124,396, 4,248,962, 4,254,212, 4,282,312, 4,296,199, 4,296,200, 4,327,173, 4,333,999, 4,334,011, 4,427,767, 4,430,423, 4,443,536, 4,444,872, 4,451,559, 4,457,559, 4,500,635, 4,511,647, 4,518,687, 4,526,864, 4,557,999, 4,564,586, 4,565,777, 4,579,813, 4,613,564, 4,690,889, 4,775,616, and 4,874,689, in Canadian Patent No. 625,822, in European Patent Application No. 0 283 938 A1, and in European Patent No. 067 689B1, the disclosures of which are incorporated by reference. Suitable couplers that form cyan dyes upon reaction with oxidized color developing agents are of the phenol type and the naphthol type. Typical couplers which form magenta dyes upon reaction with oxidized color developing agents are described in such representative patents and publications as U.S. Pat. Nos. 1,969,479, 2,311,082, 2,343,703, 2,369,489, 2,600,788, 2,908,573, 3,061,432, 3,062,653, 3,152,896, 3,311,476, 3,419,391, 3,519,429, 3,615,506, 3,725,067, 3,935,015, 3,936,015, 4,119,361, 4,120,723, 4,351,897, 4,385,111, 4,413,054, 4,443,536, 4,500,630, 4,522,916, 4,540,654, 4,581,326, 4,774,172, 4,853,319, and 4,874,689, Japanese Published Patent Application No. 60/170,854, European Patent Publication Nos. 0 170 164, 0 177 765, 0 240 852 A1, 0 283 938 A1, 0 284 239 A1, 0 284 240 A1, and 0 316 955 A3, and Research Disclosures 24220 (June 1984) and 24230 (June 1984), the disclosures of which are incorporated by reference. Suitable couplers that form magenta dyes include pyrazolone, pyrazolotriazole, and pyrazolobenzimidazole compounds. Typical couplers which form yellow dyes upon reaction with oxidized color developing agent are described in such representative U.S. Pat. Nos. as 2,298,443, 2,875,057, 2,407,210, 2,875,057, 3,265,506, 3,384,657, 3,408,194, 3,415,652, 3,447,928, 3,542,840, 3,894,875, 3,933,501, 4,022,620, 4,046,575, 4,095,983 4,133,958, 4,182,630, 4,203,768, 4,221,860, 4,326,024, 4,401,752, 4,443,536, 4,529,691, 4,587,205, 4,587,207 and 4,617,256, 4,622,287, 4,623,616, and in European Patent Applications 0 259 864 A2,096 93 A1, 0 283 938 A1, and 0 316 955 A3, the disclosures of which are incorporated by reference. Suitable yellow dye image forming couplers are acylacetamides, such as benzoylacetanilides and pivaloylacetanilides.

Diffusible Dye-Releasing Couplers

Diffusible-dye releasing compounds of any type may be utilized, so long as said diffusible dyes are diffusible in an aqueous colloid such as gelatin and related hydrophilic colloids and so long as said compounds can be dispersed in aqueous colloid as solid particle dispersions. Said diffusible dyes preferably contain solubilizing groups. Preferred are compounds according to formula I Cp -L-Dye (I)

wherein Cp is a coupler radical, L is a divalent linking group, and Dye is a dye radical exhibiting selective absorption in the visible spectrum and contains a solubilizing group. Coupler radicals Cp capable of forming cyan, magenta, yellow, colorless, and black or brown dye by coupling with an aromatic primary amine developing agent are described in detail in copending and commonly assigned U.S. application Ser. No. 07/952,444, Dye Releasing Couplers for Color Diffusion Transfer Elements of Welter and Texter filed Sep. 28, 1992, the disclosure of which is incorporated herein by reference in its entirety.

The linking group may be any divalent group that attaches to the coupling position of Cp and to the Dye such that the coupling-off group, comprising the linking group L and the Dye, —L-Dye, is released from the coupler upon reaction of oxidized developer with the coupling moiety and such that the Dye moiety is subsequently released from the coupling-off group. Linking groups suitable for the present invention have been described in U.S. Pat. Nos. 4,248,962, 4,409,323, and 4,840,884, and in U.S. application Ser. No. 07/952,444, Dye Releasing Couplers for Color Diffusion Transfer Elements of Welter and Texter filed Sep. 28, 1992, the disclosures of which are incorporated herein by reference. The group L can contain moieties and substituents which will permit control of one or more of the rate of reaction of Cp with oxidized color developing agent, the rate of diffusion of the coupling off group, the rate of release of Dye, and the crystallinity of said dye-releasing coupler. Linking groups L-1 through L-14 described in U.S. application Ser. No. 07/952,444, Dye Releasing Couplers for Color Diffusion Transfer Elements of Welter and Texter filed Sep. 28, 1992, the disclosure of which is incorporated herein by reference, are preferred, because of the latitude in reactivity they provide dye-releasing couplers and the controlled diffusibility they provide dyes released from said dye-releasing couplers subsequent to reaction of said couplers with oxidized developer and prior to separation of said linking group from said released dye.

The Dye moiety may be any diffusible dye or diffusible-dye precursor including azo, azamethine, methine, azopyrazolone, indoaniline, indophenol, anthraquinone, triarylmethane, alizarin, nitro, quinoline, or phthalocyanine dyes or precursors of such dyes such as leuco dyes or shifted dyes. Such dyes are described for example in U.S. Pat. Nos. 3,880,658, 3,931,144, 3,932,380, 3,932,381, 3,942,987, 4,248,962, and 4,840,884, and in U.S. application Ser. No. 07/952,444, Dye Releasing Couplers for Color Diffusion Transfer Elements of Welter and Texter filed Sep. 28, 1992, the disclosures of which are incorporated herein by reference. Such dyes, in the present invention, also have a solubilizing group to insure diffusibility in an aqueous alkaline development environment. Such solubilizing groups include hydroxy, carboxy, substituted or unsubstituted amino, substituted or unsubstituted sulfonamido, substituted or unsubstituted sulfamoyl, sulfonic, sulfate, and phosphate groups.

Color developing agents which are useful with the non-diffusing couplers and compounds of this invention include the following:

4-amino-N-ethyl-3-methyl-N-β-sulfoethyl)aniline
4-amino-N-ethyl-3-methoxy-N-(β-sulfoethyl)aniline
4- amino-N-ethyl-N-(β-hydroxyethy)aniline
4-amino-N,N-diethyl-3-hydroxymethyl aniline
4-amino-N-methyl-N-(β-carboxyethyl)aniline
4- amino-N,N-bis-(β-hydroxyethyl)aniline
4-amino-N,N-bis-(β-hydroxyethyl)-3-methyl-aniline
3-acetamido-4-amino-N,N-bis-(β-hydroxyethyl)aniline
4-amino-N-ethyl-N-(2,3-dihydroxypropoxy)-3-methyl aniline sulfate salt
4-amino-N,N-diethyl-3-(3-hydroxypropoxy)aniline.

Preparation of Coupler Dispersions

The invention colloidal dispersions of microcrystalline coupler can be obtained by any of the methods for imparting mechanical shear well known in the art, such as those methods described in U.S. Pat. Nos. 2,581,414 and 2,855,156 and in Canadian Patent No. 1,105,761, the disclosures of which are incorporated herein by reference. These methods include solid-particle milling methods such as ball-milling, pebble-milling, roller-milling, sand-milling, bead-milling, dyno-milling, Masap-milling, and media-milling. These methods further include colloid milling, milling in an attriter, dispersing with ultrasonic energy, and high speed agitation (as disclosed by Onishi et al. in U.S. Pat. No. 4,474,872 and incorporated herein by reference). Ball-milling, roller-milling, media-milling, and milling in an attriter are preferred milling methods because of their ease of operation, cleanup, and reproducibility.

Alternatively, coupler dispersions wherein said coupler is present in an amorphous physical state may be prepared by well known methods including colloid milling, homogenization, high speed stirring, sonication methods. The amorphous physical state of said coupler may then be transformed into a microcrystalline physical state by methods including thermal annealing and chemical annealing. Thermal annealing methods include temperature programmed thermal cycling to temperatures above any glass transition temperature of the amorphous coupler. Preferred thermal annealing comprises cycling said dispersion over the temperature range of 17° to 90° C. Said cycling may comprise any sequence of temperature changes that promotes microcrystalline phase formation from an extant amorphous physical state. Typically the duration of high temperature intervals are chosen to activate said phase formation while minimizing particle growth from ripening and collision processes. Chemical annealing methods include incubation with chemical agents that modify partitioning of couplers and surfactants between the continuous phase of said dispersion and the discontinuous phase. Such agents include hydrocarbons (such as hexadecane), surfactants, alcohols (such as butanol, pentanol, and undecanol), and high boiling organic solvents. Said agents may be added to the dispersion during or subsequent to particle formation. Said chemical annealing may include incubating said dispersion at 17° to 90° C. in the presence of said agent, stirring said dispersion in the presence of said agent, adding said agent and then removing it slowly by diafiltration methods.

The formation of colloidal dispersions in aqueous media usually requires the presence of dispersing aids such as surfactants, surface active polymers, and hydrophilic polymers. Such dispersing aids have been disclosed by Chari et al. in U.S. Pat. No. 5,008,179 (columns 13–14) and by Bagchi and Sargeant in U.S. Patent No. 5,104,776 (see columns 7–13) and are incorporated herein by reference. Preferred dispersing aids include sodium dodecyl sulfate (DA-1), sodium dodecyl benzene sulfonate (DA-2), sodium bis(2-ethyl hexyl)sulfosuccinate (DA-3), Aerosol-22 (Cyanamid), sodium bis(1-methyl pentyl)sulfosuccinate (DA-4), sodium bis(phenylethyl)sulfosuccinate (DA-5), sodium bis(β-phenyl ethyl)sulfosuccinate (DA-6), sodium bis(2-phenyl propyl)sulfosuccinate (DA-7), and the following:

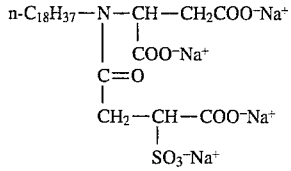

(DA-8)

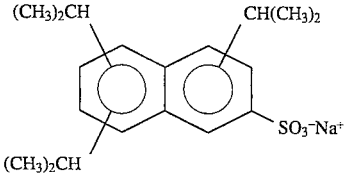

(DA-9)

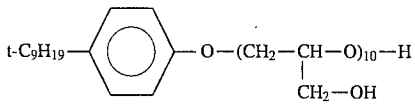

(DA-10)

-continued $$n\text{-}C_{12}H_{25}-O-(CH_2CH_2O)_{12}-SO_3^-Na^+ \quad \text{(DA-11)}$$

(DA-12)

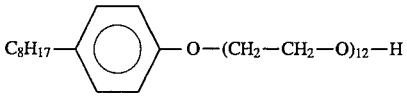

$$n\text{-}C_{12}H_{25}O-(CH_2CH_2O)_{23}-OH \quad \text{(DA-13)}$$

$$n\text{-}C_{12}H_{25}-O-(CH_2CH_2O)_{15}-CH_2CH_2-SO_3^-Na^+ \quad \text{(DA-14)}$$

(DA-15)

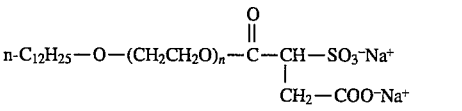

(DA-16)

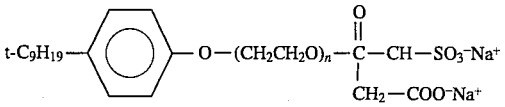

(DA-17)

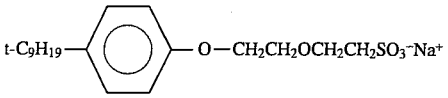

Preferred hydrophilic polymers include gelatin, polyvinylalcohol, and polyvinylpyrollidone. Such dispersing aids are typically added at level of 1%–200% of dispersed coupler (by weight), and are typically added at preferred levels of 3%–30% of dispersed coupler (by weight).

Colloidal microcrystalline coupler particles less than 1 μm in largest dimension are preferably obtained because of their propensity to scatter less light than larger particles. More preferably because of higher surface to volume ratios, colloidal microcrystalline coupler particles less than 0.2 μm in largest dimension are obtained.

Film Structures and Multilayer Formats

Important to this invention is the arrangement of various generic layers in the integral diffusion transfer element. The basic layers may be described as (1) a support, (2) a mordanting layer for fixing diffusible dye, (3) an imaging layer comprising radiation sensitive material and diffusible dye forming compounds, and (4) a barrier layer for impeding the diffusion of diffusible dye while said element is in contact with an external developing bath. Said radiation sensitive material is preferably silver halide. Any of these basic layers may comprise one or more actual layers. It is preferred that one and only one dimensionally stable support be used in the elements of the present invention.

In a preferred embodiment illustrated in Table 1, Layer Structure 1, these generic layers are arranged in the above listed sequence, and a stripping layer is incorporated between the mordanting and imaging layers. In the preferred Layer Structure 1 the light sensitive imaging layer is exposed through the barrier layer, and said structure is developed by contacting said barrier layer with a large volume development bath. After development, a stop bath and/or a wash bath are applied by contacting with said barrier layer, and the element is subsequently stripped to separate the dye diffusion transfer image, found in the dye fixing or mordant layer from the radiation-sensitive material-image in the imaging layer.

TABLE 1

| Layer Structure 1 |
|---|
| Barrier Layer |
| Diffusible-Dye Releasing (Imaging) Layer |
| Stripping Layer |
| Mordant (Dye Fixing) Layer |
| Reflection Base (Support) |

In another preferred embodiment, the above layers are arranged in the sequence: (1) a transparent support; (2) a mordanting layer for fixing diffusible dye; (3) an imaging layer comprising radiation sensitive material and diffusible dye forming compounds; and (4) a barrier layer for impeding the diffusion of diffusible dye while said element is in contact with an external developing bath. Said embodiment further comprises an opacifying reflection layer placed between said mordanting and imaging layers, wherein said reflection layer is permeable to said diffusible dye. Any of these illustrated layers may have additional interlayers of any type adjacent to said illustrated layers. Such additional interlayers may comprise oxidized developer scavengers, matting agents, gelatin, silver halide, colloidal silver, highly scattering pilaments, filter dyes of any type, UV absorbing dyes of any type, etc. The diffusible-dye releasing imaging layer may comprise two or several layers, wherein light sensitive material such as silver halide and diffusible-dye releasing couplers are in separate layers. In the preferred Layer Structure 2 the light sensitive imaging layer is exposed through the barrier layer, and said structure is developed by contacting said barrier layer with a large volume development bath. After development, a stop bath and/or a wash bath is/are applied by contacting with said barrier layer. The final image in the mordant layer is viewed through the transparent support.

TABLE 2

| Layer Structure 2 |
|---|
| Barrier Layer |
| Diffusible-Dye Releasing (Imaging) Layer |
| Opacifying Reflection Layer |
| Mordant (Dye Fixing) Layer |
| Transparent Base (Support) |

In another preferred embodiment, the above layers are arranged in the sequence: (1) a transparent support; (3) an imaging layer comprising radiation sensitive material and diffusible-dye forming compounds; (2) a mordanting layer for fixing diffusible dye; and (4) a barrier layer for impeding the diffusion of diffusible dye while said element is in contact with an external developing bath. Said embodiment further comprises an opacifying reflection layer placed between said mordanting and imaging layers, wherein said reflection layer is permeable to said diffusible dye. Any of these illustrated layers may have additional interlayers of any type adjacent to said illustrated layers. Such additional interlayers may comprise oxidized developer scavengers, matting agents, gelatin, silver halide, colloidal silver, highly scattering pilments, filter dyes of any type, UV absorbing dyes of any type, etc. The diffusible-dye releasing imaging layer may comprise two or more layers, wherein light sensitive material such as silver halide and diffusible-dye releasing couplers are in separate layers. In the preferred Layer Structure 3 the light sensitive imaging layer is exposed through the transparent support. Said structure is developed by contacting said barrier layer with a large volume development bath. After development, a stop bath and/or a wash bath is/are applied by contacting with said barrier layer. The final image in the mordant layer is viewed through the transparent support.

TABLE 3

| Layer Structure 3 |
|---|
| Barrier Layer |
| Mordant (Dye Fixing) Layer |
| Opacifying Reflection Layer |
| Diffusible-Dye Releasing (Imaging) Layer |
| Transparent Base (Support) |

Many embodiments may be constructed, with variations in layer structure and composition, which fall within the spirit and scope of the present invention, so long as said embodiments comprise the above listed basic layers and further do so such that said barrier layer is situated so as to impede the diffusion of diffusible dyes into an external developing bath.

Mordant Layers

Mordant layers are formulated as combinations of hydrophilic colloidal binder and mordants. Particularly effective mordants comprise polymers that have high binding affinity for diffusible dyes. Suitable hydrophilic colloidal binders include gelatin, gelatin derivatives, polyvinyl alcohol, cellulose derivatives, polysaccharides such as starches and gum arabic, synthetic substances such as water soluble polyvinyl compounds, synthetic substances such as dextrin, pullulan, polyvinyl pyrrolidone and acrylamides. Gelatin is a preferred hydrophilic colloidal binder because of its low cost and ease of use in photographic elements and processes. Mordant layers are dye fixing layers. It is known to incorporate UV stabilizers in such dye fixing layers. Such incorporation of UV stabilizers in dye fixing layers has the advantage of achieving UV stabilization without the added cost of coating a separate UV filter layer. It is also known to separate such layers into two sublayers, where one of said sublayers comprises mordant polymer and the other of said sublayers comprises a UV stabilizer. This approach, while suffering the added cost of coating an extra layer, has the advantage of providing superior UV protection and stabilization to the dye image.

Mordant polymers that contain a vinyl monomer unit having a tertiary amino group or a quaternary ammonium group are preferred because of their ease of synthesis by radical polymerization and because of the binding affinity for diffusible dyes such groups provide. Such preferred mordant polymers have been described by Aono et al. in U.S. Pat. No. 4,636,455 incorporated herein by reference. Said mordant polymers comprise vinyl monomer units selected from the group consisting of:

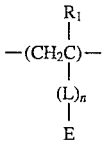

mo-i wherein $R_1$ is a hydrogen atom or a lower alkyl group having 1 to 16 carbon atoms; L represents a divalent linking group having 1 to 20 carbon atoms; E represents a hetero ring confining a carbon-nitrogen double bond; and n is 0 or 1;

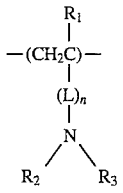

mo-ii wherein $R_1$, L, and n have the same meaning as in formula mo-i; $R_2$ and $R_3$ are the same or different and each represents an alkly group having 1 to 12 carbon atoms or an aralky group having 7 to 20 carbon atoms, and $R_2$ and $R_3$ may form, together with the adjacent nitrogen atom, a cyclic structure;

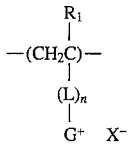

mo-iii wherein $R_1$, L, and n have the same meaning as in formula mo-i; $G^+$ represents a hetero ring which is quaternized and contains a carbon-nitrogen double bond; and $X^-$ represents a monovalent anion; and

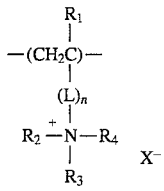

mo-iv wherein $R_1$, L, and n have the same meaning as in formula mo-i; $R_2$ and $R_3$ have the same meaning as in formula mo-ii; $R_4$ has the same definition as $R_2$ and $R_3$; $X^-$ has the same meaning as in formula mo-iii, and $R_2$ and $R_3$, $R_3$ and $R_4$, or $R_2$ and $R_4$ may form, together with the adjacent nitrogen atom, a cyclic structure.

Mordant polymers as described by Klein et al., in U.S. Pat. No. 4,450,224, incorporated herein in its entirety by reference, and comprising vinyl imidazolium, vinyl imidazole, acrylonitfile, methacrylonitrile, and α, β-ethylenically unsaturated monomers are preferred for formulating mordant layers because of their effectiveness in binding diffusible dyes.

Copolymers of imidazole containing monomers and sulfinic acid containing monomers are suitable mordant polymers. Such mordant polymers have been described by Nakamura et al. in U.S. Pat. No. 4,594,308, the disclosure of which is incorporated herein by reference. Other suitable mordant polymers comprising imidazole containing repeat units have been disclosed by Shibata and Hirano in U.S. Pat. No. 4,774,162, the disclosure of which is incorporated herein in its entirety. Preferred mordant polymers are depicted in Table 6, wherein the repeating-unit subscripts indicate weight percents of the respective repeating units and wherein the chloride anion may be replaced with any monovalent anion.

The mixture of colloidal binder (preferably gelatin) and mordant polymer and the amount coated in the formulation of the mordant layer may be any suitable amount and will vary according to the particulars of the element and use, such as the particular polymeric mordant used and the particular development process used. The ratio of mordant polymer to binder is preferably in the range of 1:5 to 5:1 (weight ratio) because suitable compliance and ductility of said mordant layer is thereby maintained, and the amount of mordant polymer coated is preferably in the range of 0.2–15 $g/m^2$, more preferably in the range of 0.5–8 $g/m^2$ in order to obtain suitable dye binding while not providing an excessively think mordant layer. The molecular weight of the polymer mordant used is preferably in the range of 1,000–1,000,000, and more preferably in the range of about 10,000–200,000, so as to obtain coating solutions and suspensions in the coating of mordant layers, wherein said solutions and suspensions have suitable viscosities for high speed coating operations encountered in the manufacture of photographic elements.

Stripping Layers

Stripping layers are included in preferred embodiments to facilitate the mechanical separation of receiver layers and mordant layers from donor layers and diffusible dye forming layers. Stripping layers are usually coated between a mordant containing layer or dye receiving layer and one or more diffusible dye forming layers. Stripping layers may be formulated essentially with any material that is easily coatable, that will allow processing chemistry and solutions to pass therethrough, that will maintain dimensional integrity for a sufficient length of time so that a suitable image may be transferred by dye diffusion therethrough with sufficiently adequate density and sharpness, and that will facilitate the separation of donor and receiver components of the photographic element under wet or dry stripping conditions. Said dimensional stability must be maintained during storage and at least partway through the development and dye forming process. In preferred embodiments this dimensional stability is maintained during all wet processing steps and during subsequent drying. Various stripping polymers and stripping agents may be used alone and in combination in order to achieve the desired strippability in particular processes with particular photographic elements. The desired strippability in a given process is that which results in clean separation between the image receiving layer and the emulsion and diffusible dye forming layers adhering to the image receiving layer. Good results have in general been obtained with stripping agents coated at level of 3 $mg/m^2$ to about 500 $mg/m^2$. The particular amount to be employed will vary, of course, depending on the particular stripping agent employed and the particular photographic element used, and the particular process employed.

Perfluorinated stripping agents have been disclosed by Bishop et al. in U.S. Pat. No. 4,459,346, the disclosure of which is incorporated herein in its entirety by reference. Other preferred stripping agents and polymers are described on pages 15–17 in U.S. application Ser. No. 07/952,444, *Dye Releasing Couplers for Color Diffusion Transfer Elements of Welter and Texter* filed Sep. 28, 1992, the disclosure of which is incorporated herein by reference.

If the process of this invention is used to produce a transparency element for use in high magnification projection, it is desirable to maintain sharpness and to minimize the distance of dye diffusion. This minimization is achieved in part by using a stripping layer that does not swell appreciably and which is as thin as possible. These requirements are met by the perfluoronated stripping agents herein described in the disclosures incorporated by reference. These stripping agents provide clean stripping and do not materially alter the surface properties at the stripping interface. The above referenced perfluoronated stripping agents provide for a stripping layer with weak dry adhesion and are preferred for dry stripping. A strong dry adhesion makes separation of substantially dry elements difficult.

Wet stripping is facilitated by stripping polymers that are soluble in processing solution, or become soft in such a solution. Suitable polymers for wet stripping include gum arabic, sodium alginate, pectin, cellulose acetate hydrogen phthalate, polyvinyl alcohol, hydroxyethyl cellulose, agarose, polymethacrylic acid, plasticized methyl cellulose, ethyl cellulose, methyl methacrylate, butyl methacrylate, and polyethylene oxide. The disclosures of Land (in U.S. Pat. No. 3,220,835) and of Dannhauser (in U.S. Pat. No. 3,730,718) describe stripping layer formulations suitable for the present invention and are incorporated herein in their entirety by reference. Also suitable for the present invention are stripping layers formulated with polyaddition products of bisacrylamides and diamines, as disclosed by Tsuji et al. (in U.S. Pat. No. 3,820,999), the disclosure of which is incorporated herein by reference.

Barrier Layers

The barrier layers of the present invention serve to reflect diffusible dyes and diffusible-dye-precursors during aqueous development while allowing aqueous processing solutions to pass. Certain polymers of this invention are used as barrier layers to diffusible dyes and their precursors. The barrier polymers of this invention contain ion forming functional groups in amounts from about $1\times10^{-5}$ to about $4\times10^{-3}$ moles/gram of polymer and preferably from about $5\times10^{-5}$ to about $2\times10^{-3}$ moles/gram of polymer. Additionally, the barrier polymers of this invention do not contain groups which significantly absorb, scavenge, or mordant diffusible dyes, for example, secondary, tertiary, or quaternary ammonium groups. The barrier polymer should contain a balance of hydrophobic and hydrophilic entities such that they are swellable, but not fully soluble in water or processing solutions as coated. They should also allow the passage of processing solutions, either when coated alone or in combination with gelatin. Further, they should be dispersible or soluble in water as formulated for coating. The molecular weight of said barrier polymers is preferably in the range of 50,000 to 1,000,000 so that said barrier polymers are practical to coat.

The barrier polymers may contain repeating units derived from any monomers which can be used in photographic elements provided the resulting polymer meets the ionic content requirement defined above and has the correct water swellability in the processing solutions. These can include, among others, water dispersible polyesters, polyamides, polyethers, polysulfones, polyurethanes, polyphosphazenes, and chemically modified naturally-occurring polymers such as proteins, polysaccharides, and chitins. Preferred monomers are vinyl monomers, particularly acrylate, methacrylate, acrylamide and methacrylamide monomers which includes analogs of said monomers, because such monomers are highly suitable for radical polymerization.

The more preferred barrier polymers contain repeating units of the formula—(A)-(B)—wherein A is a hydrophobic ethylenically unsaturated monomer and B is an ionic hydrophilic ethylenically unsaturated monomer, because such hydrophobic/hydrophilic mixtures are effective in providing diffusible-dye reflection and processing solution permeability. A may be selected from, for example, vinyl ketones, alkylvinyl esters and ethers, styrene, alkylstyrenes, halostyrenes, acrylonitrile, butadiene, isoprene, chloroprene, ethylene and alkyl substituted èthylenes, alkyl substituted acrylamides, alkyl substituted methacrylamides, haloethylenes, and vinylidene halides. Examples of hydrophobic monomers are listed in *Research Disclosure* No. 19551, p. 301, Jul., 1980 hereby incorporated by reference. B may be selected from any class of vinyl monomers having an ion forming functional group and that can undergo free radical polymerization, for example, itaconic and fumaric acids, vinyl ketones, N-vinyl amides, vinyl sulfones, vinylethers, vinylesters, vinyl urylenes, vinyl urethanes, vinyl nitriles, vinylanhydrides, allyl amine, maleic anhydride, maleimides, vinylimides, vinylhalides, vinyl aldehydes, substituted styrenes, and vinyl heterocycles. Other examples of ionic monomers are listed in *Research Disclosure* No. 19551, p. 303, July 1980 hereby incorporated by reference. The more preferred monomers of group A and B are acrylamides, methacrylamides, acrylates, and methacrylates.

The ion forming functional groups of B may be ionic groups, ion forming functional groups or groups which can undergo a subsequent reaction resulting in the formation of an ionic group, e.g. by hydrolysis or by pH induced protonation. Any ion forming functional group will work in this invention provided its presence augments the water swellability of the polymer during processing. Suitable ion forming groups will be apparent to those skilled in the art. The ion forming groups can be either cationic or anionic and the polymers may contain monomers with opposite charges such that the polymers are zwitterionic.

Particularly preferred are polymers containing repeating units derived from ethylenically unsaturated monomers of the formula $—(A)_m—(B)_n—$, A is a hydrophobic monomer having the structure

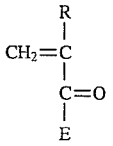

where R is hydrogen or methyl; E is $—OR_2$ or $—NR_3R_4$; $R_2$ is a substituted or unsubstituted straight, branched, or cyclic alkyl or aryl group of about 1 to 10 carbon atoms; $R_3$ and $R_4$ are independently selected from hydrogen or any $R_2$ group and $R_3$ and $R_4$ together contain at least 3 carbon atoms; and m is 0 to 99.5 mole percent. B is an ionic hydrophilic monomer having the structure

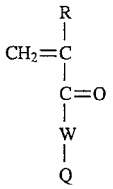

wherein R is hydrogen or methyl; W is $—OR_5$ or $—NR_6R_7$; $R_5$ is a straight, branched, or cyclic alkylene or arylene group of 1 to about 10 carbon atoms; $R_6$ is hydrogen or a straight, branched, or cyclic alkyl or aryl group from 1 to about 6 carbon atoms; $R_7$ is a straight, branched or cyclic alkylene or arylene group of 1 to about 10 carbon atoms, n is 0.5 to 100 mole percent; and Q is an ionic functional group independently selected from:

(a) $—NH_2$ or the acid addition salt $—NH_2$:HX, where X is an appropriate acid anion or (b) $—CO_2M$, $—SO_3M$, $—OSO_3M$, $—OPO_3M$, and —OM where M is an appropriate cation.

$R_2$, $R_3$, and $R_4$ of formula A may be substituted with any non-ion forming group that does not interfere with the hydrophobic nature of the monomer or prevent polymerization. Examples of substituents are halide, alkoxy, acryloxy, styryl, sulfoxyalkyl, sulfoalkyl, nitro, thio, keto, or nitrile groups. The monomers of group A may also contain reactive functional groups so that the polymers may perform other photographically useful functions common to interlayers between imaging layers and protective layers over imaging layers. $R_2$, $R_3$, $R_4$, $R_5$, $R_6$ and $R_7$ may be substituted with groups that can form heterocyclic rings. The straight, branched or cyclic alkyl groups of A and B include all isomeric forms and may contain one or more sites of unsaturation. The more preferred monomers of group A contain unsubstituted straight or branched alkyl groups of 4 to 8 carbon atoms and the more preferred monomers of group B contain straight or branched alkyl groups of 3 to 8 carbon atoms. The most preferred monomers of both A and B are acrylamides or methacrylamides monosubstituted on the amide nitrogen. For the polymers of this invention m is 0 to about 99.5 mole percent and n is about 0.5 to 100 mole percent.

The acid ions and cations of Q may be organic or inorganic. Appropriate anions include, but are not limited to, $Cl^-$, $Br^-$, $ClO_4^-$, $I^-$, $F^-$, $NO^-$, $HSO_4^-$, $SO_4^{2-}$, $HCO_3^-$, and $CO_3^{2-}$ with $Cl^-$ being most preferred. Appropriate cations include, but are not limited to, $H^+$, alkali metal, and ammonium, with $Na^+$ and $H^+$ being most preferred.

When the polymers of this invention are derived from monomers A and B of the above formula and both A and B are acrylamide or methacrylamide monomers monosubstituted on the amide nitrogen the polymers fall within a class of polymers known as Thermo Reversible Gelling (TRG) polymers. The TRG polymers are one preferred class of polymers in this invention and are described in detail in U.S. application Ser. No. 502,726 filed Apr. 2, 1990, hereby incorporated by reference. Any TRG polymer as described in the above application is included in this invention providing it falls within the parameters described herein. When the polymer is a TRG polymer m is preferably about 40 to 99 mole percent and n is preferably about 1 to about 60 mole percent.

Examples of preferred monomers from group A are N-isopropylacrylamide, N-t-butylacrylamide, N-butylacrylamide, N-t-butylmethacrylamide, N-( 1,1-dimethyl-3-oxobutyl)-acrylamide, N-butylmethacrylate, 2-ethyl-hexylmethacrylate, and benzylmethacrylate. Examples of preferred monomers from group B are N-(3-aminopropyl)methacrylamide hydrochloride, aminoethylmethacrylate hydrochloride, sulfo-ethyl methacrylate sodium salt, N-(2-sulfo-1,1-dimethyl-ethyl)acrylamide sodium salt and N-2-carboxyethylacrylamide.

The barrier polymers of this invention may also include repeating units derived from hydrophilic nonionic monomers to enhance their water swellability and to increase their permeability to processing solutions provided that ionic functional groups continue to comprise at least $1\times10^{-5}$ moles/gram of polymer. Any hydrophilic monomer that will undergo free radical polymerization is suitable provided it does not contain secondary, tertiary, or quaternary ammonium groups. Preferred monomers are ethylenically unsaturated monomers, for example, N-vinyl pyrrolidone, N-vinyl-e-caprolactam, vinyloxazolidone, vinyl menthyloxazolidone, maleimide, N-methylol-maleimide, maleic anhydride, N-vinylsuccinamide, acryloylurea, cyanomethyl-acrylate, 2-cyanoethyl acrylate, glycerylacrylate, acryloyloxypolyglycerol, allyl alcohol, vinyl benzyl alcohol, p-methanesulfonamidostyrene, and methylvinylether. Block copolymers formed from, for example, polymethylene oxide, polypropylene oxide, and polyurethanes, with acrylate or methacrylate end groups can also be used. The more preferred monomers are acrylate, methacrylate, acrylamide and methacrylamide monomers and their analogs.

Representative monomers include N-(isobutoxymethyl)acrylamide, methyl- 2-acrylamide-2-methoxy acetate, N-hydroxypropylacrylamide, ethylacrylamidoacetate, N-acetamidoacrylamide, N-(m-hydroxyphenyl)-acrylamide, 2-acrylamide- 2-hydroxymethyl-1,3-propane diol, and N-(3- or 5-hydroxymethyl-2-methyl-4-oxo-2-pentyl)acrylamide. Other suitable hydrophilic monomers are listed in Research Disclosure No. 19551, p.305, Jul. 1980 hereby incorporated by reference. Examples of preferred hydrophilic nonionic monomers are acrylamide, methacrylamide, N,N-dimethylacrylamide, hydroxyethylacrylamide, hydroxyethyl acrylate, hydroxyethylmethacrylate, hydroxypropyl acrylate, hydroxypropylmethacrylate, and methylene-bis-acrylamide. The hydrophilic nonionic monomer may be 0 to about 70 mole percent and preferably about 10 to 65 mole percent.

The barrier polymer layers must also have enough physical integrity to survive processing intact. Those skilled in the art will recognize that many of the monomers discussed above contain structural elements that will meet this parameter. For example polymers containing the cationic hydrophilic monomer N-( 3-aminopropyl)-methacrylamide hydrochloride also crosslink in the presence of many gelatin hardeners. Barrier polymers of this invention, however, may also contain additional monomers having groups which can be crosslinked by conventional photographic gelatin hardeners. These monomers can include, but are not limited to, aldehydes, bis(vinylsulfonyl)compounds, epoxides, aziridines, isocyanates, and carbodimides. Preferred are monomers containing active methylene groups such as 2-acetoacetoxy-ethylmethacrylate, ethylmethacryloylacetoacetate, and N-2-acetoacetoxyethyl)-acrylamide. Alternatively, di- or multi-functional monomers such as methylene-bisacrylamide or ethylene glycol-dimethacrylate may be used, whereby polymers are prepared as crosslinked colloidal particles that are swellable and dispersible in water. Particularly preferred barrier polymers, because of their ease of synthesis and because of their effectiveness in reflecting diffusible dyes, of this invention are comprised of monomers whose structures are shown below in Table 6, and are listed in Table 7 which provides the monomer feed ratios used, charge type, and also indicates which of the polymers are of the preferred TRG class.

The barrier polymers can be prepared by synthetic procedures well known in the art. The polymers of this invention may be coated in the conventional manner. The amount of permeability of the barrier layer may be adjusted by adding gelatin or other water soluble polymers to the layer. Such water soluble polymers may comprise up to 50 percent of the barrier layer, but preferably no more than 25 percent. This method of adjusting permeability is particularly useful with polymers containing a high proportion of hydrophobic monomers and can alleviate the need to prepare different polymers of varying desired levels of permeability. The permeability of the layer may also be adjusted by varying the thickness of the polymer or polymer/gelatin layer. It has also been noted that surfactants or surfactant-like compounds, used with the polymer may affect the permeability. The surfactants or surfactant-like compounds, for example 2,5-dihydroxy-4-(1-methyl heptadecyl) benzenesulfonic acid-monopotassium salt, are not added directly to the barrier layer but may be utilized in other layers. These surfactant compounds may diffuse and become associated with the polymer layer and affect the hydrophobicity of the polymer layer. All surfactants appear to increase the hydrophobic nature of the subject polymer layers, but surfactants or surfactant-like compounds of opposite charge to the utilized polymer are more effective at reducing permeability. The TRG polymers described above are a particularly preferred class of polymers of this invention. Solutions of such polymers are advantageous for coating because they can either be heat thickened or chill thickened upon application to a film to form layers with sharp and distinct interfaces. The preparation of TRG polymers is more fully described in copending and commonly assigned U.S. application Ser. No. 8/059,039 of Roberts et al. filed May 7, 1993, which is incorporated herein by reference.

TABLE 4

Monomers for Barrier Layer Polymers $CH_2{=}C(XX)(YY)$

Hydrophobic Monomers

IPA (N-isopropylacrylamide)
XX = —H
YY = —(CO)—(NH)—$CH(CH_3)_2$
TBA (N-t-butylacrylamide)
XX = —H
YY = —(CO)—(NH)—$C(CH_3)_3$
NBA (N-butylacrylamide)
XX = —H
YY = —(CO)—(NH)—$C_4H_9$
TBMA (N-t-butylmethacrylamide)
XX = —$CH_3$
YY = —(CO)—(NH)—$C(CH_3)_3$
DOA (N-(1,1-dimethyl-3-oxobutyl)-acrylamide)
XX = —H
YY = —(CO)—(NH)—$C(CH_3)_2$—$CH_2$—(CO)—$CH_3$
NBM (N-butylmethacrylate)
XX = —$CH_3$
YY = —(CO)—O—$C_4H_9$
2EHM (2-ethyl-hexylmethacrylate)
XX = —$CH_3$ TABLE 4-continued Monomers for Barrier Layer Polymers $CH_2{=}C(XX)(YY)$

YY = —(CO)—O—$CH_2CH(C_2H_5)CH_2CH_2CH_2CH_3$

BZM (benzylmethacrylate)

XX = —$CH_3$

YY = —(CO)—O—$CH_2$-phenyl

AAM (2-acetoacetoxyethylmethacrylate; a crosslinker)

XX = —$CH_3$

YY = —(CO)—O—$CH_2CH_2$—O—(CO)—$CH_2$—(CO)—$C_4H_9$-n

Neutral Hydrophilic Monomers

A (acrylamide)

XX = —H

YY = —(CO)—$NH_2$

HEM (hydroxyethylmethacrylate)

XX = —$CH_3$

YY = —(CO)—O—$CH_2CH_2OH$

MBA (methylene-bis-acrylamide; difunctional)

$CH_2{=}CH$—(CO)—(NH)—$CH_2$—(NH)—(CO)—$CH{=}CH_2$

Cationic Hydrophilic Monomers

APM (N-(3-aminopropyl)methacrylamide hydrochloride)

XX = —$CH_3$

YY = —(CO)—(NH)—$CH_2CH_2CH_2NH_3^+Cl^-$

AEM (aminoethylmethacrylate hydrochloride)

XX = —$CH_3$

YY = —(CO)—O—$CH_2CH_2NH_3^+Cl^-$

Anionic Hydrophilic Monomers

SEM (sulfoethylmethacrylate sodium salt)

XX = —$CH_3$

YY = —(CO)—O—$CH_2CH_2SO_3^-Na^+$

SSA (N-(2-sulfo-1,1-dimethylethyl)acrylamide sodium salt)

XX = —$CH_3$

YY = —(CO)—(NH)—$C(CH_3)_2CH_2SO_3^-Na^+$

CEA (N-2-carboxyethylacrylamide)

XX = —H

YY = —(CO)—(NH)—$CH_2CH_2CO_2H$

TABLE 5

Monomer Composition of Barrier Layer Polymers

| Label | Type | Monomers | Monomer Ratio | TRG? | Ratio % |
|---|---|---|---|---|---|
| D | + | (IPA)(APM) | 90:10 | Yes | Mole |
| E | + | (IPA)(APM) | 92:8 | Yes | Mole |
| F | + | (IPA)(A)(APM) | 85:10:5 | Yes | Mole |
| G | + | (TBA)(APM) | 75:25 | Yes | Mole |
| H | + | (TBA)(APM) | 80:20 | Yes | Mole |
| I | + | (TBA)(APM) | 83:17 | Yes | Mole |
| J | + | (TBA)(APM) | 84:16 | Yes | Mole |
| K | + | (NBA)(APM) | 80:20 | Yes | Mole |
| L | + | (TBMA)(APM) | 80:20 | Yes | Mole |
| M | + | (TBA)(IPA)(APM) | 65:20:15 | Yes | Mole |
| N | + | (DOA)(APM) | 80:20 | Yes | Mole |
| O | + | (TBA)(DOA)(APM) | 60:20:20 | Yes | Mole |
| P | + | (IPA)(MBA)(APM) | 80:10:10 | Yes | Weight |
| Q | + | (NBM)(AEM)(HEM) | 50:15:35 | No | Weight |
| Qa | + | (NBM)(AEM)(HEM) | 50:30:20 | No | Weight |
| R | + | (NBM)(AEM)(HEM) | 40:25:35 | No | Weight |
| S | + | (NBM)(AEM)(HEM) | 26:22:52 | No | Weight |
| T | + | (NBM)(AEM)(HEM) | 20:15:65 | No | Weight |
| U | – | (TBA)(A)(SSA) | 75:20:5 | Yes | Mole |
| V | – | (NBM)(SEM)(AAM)(HEM) | 60:5:10:25 | No | Weight |
| Va | – | (NBM)(SEM)(AAM)(HEM) | 70:2.5:10:17.5 | No | Weight |
| Vb | – | (BZM)(SEM)(AAM)(HEM) | 50:2.5:10:37.5 | No | Weight |
| Vc | – | (2EHM)(SEM)(AAM)(HEM) | 50:5:10:35 | No | Weight |
| Vd | – | (NEM)(SEM)(AAM)(HEM) | 50:5:10:35 | No | Weight |
| Ve | – | (BZM)(SEM)(AAM)(HEM) | 60:2.5:10:27.5 | No | Weight |
| W | +/– | (TBA)(CEA)(APM) | 76:8:16 | Yes | Mole |
| X | +/– | (TBA)(A)(IPA)(APM) | 76:8:16 | Yes | Mole |
| Y | +/– | (TBA)(A)(SSA)(APM) | 65:20:5:10 | Yes | Mole |

Other Components

In the following discussion of suitable materials for use in the emulsions and elements according to the invention, reference will be made to Research Disclosure, December 1989, Item 308119, published by Kenneth Mason Publications Ltd., Emsworth, Hampshire P010 7DQ, U.K., the disclosures of which are incorporated in their entireties herein by reference. This publication will be identified hereafter as "Research Disclosure".

The silver halide emulsion employed in the elements of this invention can be either negative working or positive working. Examples of suitable emulsions and their preparation are described in Research Disclosure, Sections I and II and the publication cited therein. Examples of suitable vehicles for the emulsion layers and other layers of elements of this invention are described in Research Disclosure, Section IX and the publications cited therein. The composition of said silver halide is preferably 95 mole percent or greater silver chloride, and most preferably 99 mole percent or greater silver chloride.

The photographic elements of this invention or individual layers thereof can contain, for example, brighteners (see Research Disclosure, Section V), antifoggants and stabilizers (see Research Disclosure, Section VI), antistain agents and image dye stabilizers (see Research Disclosure, Section VII, paragraphs I and J), light absorbing and scattering materials (see Research Disclosure, Section VIII), hardeners (see Research Disclosure, Section IX), plasticizers and lubricants (see Research Disclosure, Section XII) antistatic agents (see Research Disclosure, Section XIII), matting agents (see Research Disclosure, Section XVD, and development modifiers (see Research Disclosure, Section XXD).

The photographic elements can be coated on a variety of supports such as described in Research Disclosure, Section XVII and the references described therein.

Photographic elements can be exposed to actinic radiation, typically in the visible region of the spectrum, to form a latent image as described in Research Disclosure, Section XVIII and then processed to form a visible dye image as described in Research Disclosure, Section XIX. Processing to form a visible dye image includes the step of contacting the element with a color developing agent to reduce developable silver halide and oxidizing the color developing agent. Oxidized color developing agent in turn reacts with the coupler to release a diffusible dye.

Said contacting of the element with a color developing agent comprises wetting at least the emulsion side of said element with a volume of processing solution that exceeds the swelling volume of the element. The requisite processing solution volume to element area ratio will preferably exceed 20 mL/m$^2$. This ratio will more preferably exceed 200 mL/m$^2$.

With negative working silver halide, the processing step described above gives a negative image. To obtain a positive (or reversal) image, this step can be preceded by development with a nonchromogenic developing agent to develop exposed silver halide, but not form dye, and then uniformly fogging the element to render unexposed silver halide developable. Alternatively, a direct positive emulsion can be employed to obtain a positive image. After image formation the element is subjected to a stop and wash bath that may be the same or different. Thereafter, the element is dried. Said stop, wash, or drying steps may be omitted.

The advantages of the present invention will become more apparent by reading the following Examples. The scope of the present invention is by no means limited by these Examples. The Examples are intended to be illustrative and not exhaustive in setting forth the invention.

Examples

The test coatings for these examples were coated as described below and in Table 6. The base with coated mordant layer and mordant polymer MP and stripping layer with stripping agent SA1 and stripping polymer SP3 described below were overcoated with a light sensitive layer comprising blue sensitized AgCl and invention solid particle coupler dispersions or comparison coupler dispersions of dye forming/releasing couplers C or Y (described below). These layers were then overcoated with a barrier layer containing barrier polymer VMX of the invention.

TABLE 6

| Layer Structure for Examples |
|---|
| VMX (966 mg/m$^2$) |
| gel (Type IV; 107 mg/m$^2$) |
| Coupler C (623 mg/m$^2$) or Y (589 mg/m$^2$) |
| Blue Sensitized AgCl (430 mg Ag/m$^2$ as AgCl) |
| gel (Type IV; 1.61 g/m$^2$) |
| SA1 (32 mg/m$^2$) |
| SP3 (54 mg/m$^2$) |
| MP (3.22 g/m$^2$) |
| gel (Type V; 3.22 g/m$^2$) |
| Reflection Base |

The preparation of mordant polymer MP, stripping layer polymer SP3 , and barrier polymer VMX are described, respectively, on pages 43–44, on page 45, and on pages 48–49 in U.S. application Ser. No. 07/952,444, Dye Releasing Couplers for Color Diffusion Transfer Elements of Welter and Texter filed Sep. 28, 1992, and are incorporated herein by reference.

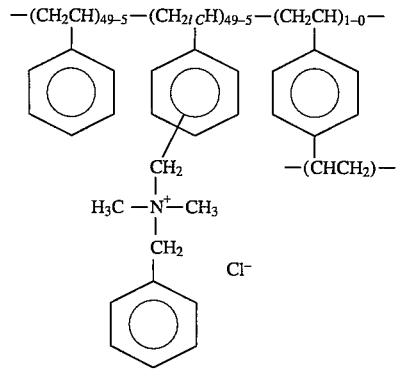

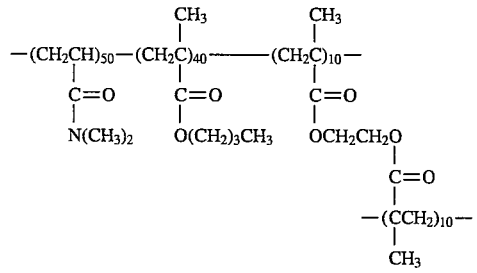

-continued

VMX

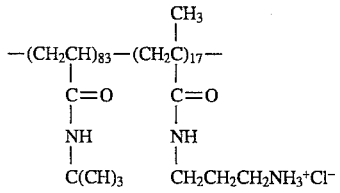

C

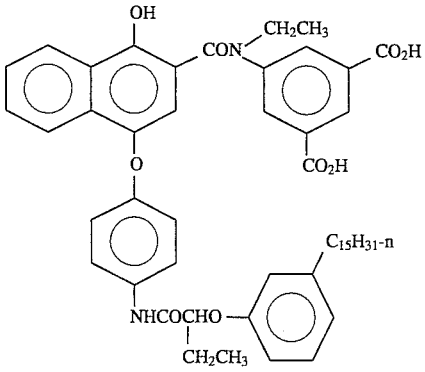

Y

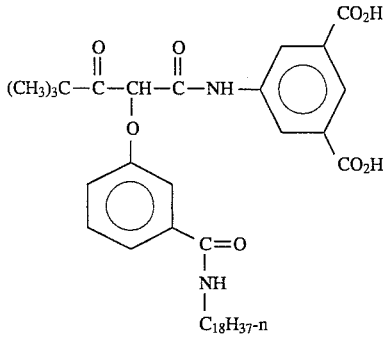

Coating base was prepared by overcoating a titania-pigmented reflection base with a gelatin-mordant polymer mixture. A slurry comprising about 259.5 g of a 17% by weight aqueous suspension of the mordant polymer MP, about 46.4 g of 95% by weight type V, Class HX/001 doubly deionized gelatin (Rouseleau), and about 931.5 g distilled water was prepared at 50° C. and chill set. This chill set slurry was then noodled and washed for several hours. The washed noodles were combined, remelted, and chill set again to yield about 840 g of slurry about 4.2% (by weight) in gelatin and MP. Titania pigmented paper reflection base was subjected to a corona discharge treatment, and thereafter overcoated with a melt comprising equal weights of gelatin and MP. This melt was prepared by combining at 50° C. about 842 g of the aforesaid gelatin/MP slurry, about 10.2 g of spreading surfactant (10% by weight Olin-10G), and about 158.6 g of distilled water. This melt was coated on the reflection base at a coverage of about 91.3 mL/m$^2$ to yield a mordant covered base with coverages of about 3.22 g/m$^2$ in both gelatin and MP. A gelatin intefiayer was then coated over this mordant layer. Type IV deionized bone gelatin was coated at a coverage of about 0.54 g/m$^2$ to form this interlayer. This base material was dried and stored until used in coating multilayer test elements.

This modified base was next overcoated with a stripping layer. A solution comprising about 22.67 g of a 6.8% (by weight) aqueous suspension of SP3, about 1.85 g of a 50% (by weight) solution of SA1 in ethyl acetate, about 2.3 g of 10% (by weight) aqueous Olin 10G, about 6.94 g of 6.7% (by weight) aqueous TX-200, and about 891 g of distilled water was prepared. This solution was coated over the mordant layer at a coverage of about 32 mL/m$^2$ to yield coverages of about 32 mg/m$^2$ for SA1 and about 54 mg/m$^2$ for SP3.

Solid particle dispersions of couplers C and Y were prepared by roller milling methods. About 3 g of coupler and about 6 g of 10% (w/w) aqueous DA-9 (Alkanol-XC; Du Pont) were combined with water to give a total weight of about 50 g. This aqueous slurry was then combined with about 100 mL of zirconia milling beads (about 1.8 mm diameter) in a glass jar and placed on a roller mill for about five days. After milling these solid particle coupler dispersions were filtered to remove the milling beads and combined with warm aqueous gelatin to give dispersions about 3% (w/w) in coupler and about 4% (w/w) in gelatin; these dispersions were then placed in the cold for storage until use.

Comparison colloid dispersions of these couplers were prepared by conventional colloid milling methods using auxiliary solvents and washing methods to remove low boiling solvents. A comparison dispersion of coupler C was prepared by combining about 2.7 g of C with about 5.4 g of ethyl acetate, and warming to dissolve the coupler. An aqueous solution at about 50° C. of 3.6 g of 10% (w/w) aqueous DA-9, 28.8 g of 12.5% (w/w) aqueous gelatin, and 49.5 g water was prepared and stirred together with this ethyl acetate solution of C. This emulsion premix was then passed through a Gaulin colloid mill five times, chill set, noodled, and washed to remove ethyl acetate. The resulting dispersion was melted, chill set, and stored in the cold. A comparison dispersion of coupler Y was prepared by combining 6.9 g of Y with 13.8 g of cyclohexanone, and warming to dissolve the coupler. An aqueous solution at about 50° C. of 9.2 g of 10% (w/w) aqueous DA-9, 73.6 g of 12.5% (w/w) aqueous gelatin, and 126.5 g water was prepared and stirred together with this cyclohexanone solution of Y. This emulsion premix was then passed through a Gaulin colloid mill five times, chill set, noodled, and washed to remove cyclohexanone. The resulting dispersion was found to be unsuitable for coating. Microscopic analysis suggested that the fine particle size character of the dispersion was destroyed during the milling/washing sequence, owing presumably to the high water solubility of this particular carboxy-solubilized coupler.

Coatings of each of the solid particle coupler dispersions or comparison dispersions of C and of the solid particle coupler dispersion of Y were made at the coverages illustrated in Table 6 using blue sensitized silver chloride emulsion. These coatings were then overcoated with a barrier layer comprising the invention barrier layer polymer VMX. Melts for coating the barrier layer were prepared by combining, at 50° C., 5% (by weight) aqueous VMX, 12.5% (by weight) aqueous gelatin, 10% (by weight) aqueous Olin 10 G, Zonyl FSN, 1.8% (by weight) aqueous hardener ( 1,1'-[methylene bis(sulfonyl)]bis-ethene), and distilled water. The Olin 10 G solution was typically added at a level corresponding to about 0.78% (by weight) of the total melt weight. The Zonyl FSN was added at a level corresponding to about 10% of the weight of aqueous Olin 10 G solution added. Hardener was typically added at a level corresponding to about 1.5% by weight of the total gelatin coated in the respective multilayer coating. Such melts were used to overcoat the coupler/mordant/base coatings at coverages typically of about 54 mL/m$^2$ to yield about 966 mg VMX/m$^2$ and about 107 mg gelatin/m$^2$.

These test coatings were exposed for 0.01 s to a tungsten light source (2850° K.) through a 0–3 density 21-step tablet and developed at 35° C. according to the following procedure. This process comprised development for 180 sec in a large volume of developer solution, a 120 sec stop treatment in a pH 4 borate buffer, a 120 sec wash in water, all at 35° C., and drying in a hot air dryer. The developer solution was prepared according to the composition described in Table 7, where the developer pH @27° C. was adjusted to 10.

The test coatings, each approximately 35 mm×305 mm in dimension, were immersed in large volume (approximately 9 L) processing tanks in each of the development, stop, and wash steps. After drying the barrier (overcoat) and imaging (emulsion and dye-releasing) layers (donor element) were removed (stripped) from the mordant/base layers (receiver element) using the method described by Texter et

TABLE 7

| | |
|---|---|
| Triethanolamine | 12.41 g |
| Phorwite REU (Mobay) | 2.3 g |
| Lithium polystyrene sulfonate (30% aqueous solution) | 0.30 g |
| N,N-diethylhydroxylamine (85% aqueous solution) | 5.40 g |
| Lithium sulfate | 2.70 g |
| KODAK Color Developing Agent CD-3 | 5.00 g |
| 1-Hydroxyethyl-1,1-diphosphonic acid (60% aqueous solution) | 1.16 g |
| Potassium carbonate, anhydrous | 21.16 g |
| Potassium bicarbonate | 2.79 g |
| Potassium chloride | 1.60 g |
| Potassium bromide | 7.00 mg |
| Water to make one liter | |

al. in U.S. Pat. No. 5,164,280. The emulsion side of the dried and processed test coatings was contacted with the gel subbed (107 mg/m$^2$) side of an ESTAR adhesive element and passed at a rate of about 5 mm/s through pinch rollers heated to a surface temperature of 110° C. and held together under a pressure of 20 psi. The receiver elements were then pulled apart from the ESTAR adhesive element, and the donor layers were thereby stripped at the stripping layer and remained attached to the adhesive element. The barrier layer served to reflect diffusible dye and to minimize dye washout while said (integral) donor and receiver elements were immersed in large volume developing, stop, and wash baths. The dye reflection property of the barrier layer was illustrated in copending U.S. application Ser. No. 07/952,447 of Texter et al. filed Sep. 28, 1992, entitled Barrier Layers for Dye Containment in Photographic Elements; the disclosure of said copending application is incorporated herein by reference. The donor layers contained undeveloped AgCl, the silver image, unreacted coupler, and a small fraction of the image dye formed. The receiver elements, on the other hand, retained most of image dye formed during color development. Reflection dye densities in the Dmin and Dmax regions of the dye receiver were then read with a densitometer using status-A filters. These values are listed below in Table 8 for Examples 1–3 and illustrate that solid particle coupler dispersions of the present invention may effectively be used to overcome colloid stability and particle integrity problems encountered in dispersing couplers in auxiliary solvents of high vapor pressure, as was found to be problematic in the present colloid milling of coupler Y, as well as effectively eliminating the need to use noxious and environmentally harmful auxiliary solvents in the dispersion making process. Note in particular that essentially equivalent image discrimination is obtained with the invention solid particle dispersion (Example 1 ) of coupler C as with the comparison colloid milled dispersion (Example 2), while the use of ethyl acetate as an auxiliary solvent in dispersion making was eliminated. Similarly, the use of the noxious cyclohexanone, as a required auxiliary solvent in the colloid milling process of coupler Y, was effectively eliminated in Example 3.

TABLE 8

| Experimental Densitometry | | | |
|---|---|---|---|
| Example | Coupler | $D_{min}$ | $D_{max}$ |
| 1 - Invention | C | 0.37 | 2.15 |
| 2 - Comparison | C | 0.40 | 2.23 |
| 3 - Invention | Y | 0.32 | 1.22 |

This invention has been described in detail with particular reference to preferred embodiments thereof, but it will be understood that variations and modifications can be effected within the spirit and scope of the invention.

What is claimed is:

1. A photographic color diffusion transfer element comprising one and only one dimensionally stable support, wherein said support comprises an opaque and light reflecting layer, and coated thereon in reactive association and in sequence (1) a mordant layer for binding diffusible dyes, (2) a stripping layer, (3) one or more layers comprising radiation sensitive silver halide, a solid particle dispersion of a diffusible-dye forming compound, or radiation sensitive silver halide and a solid particle dispersion of a diffusible-dye forming compound, and (4) a barrier layer comprising a polymer that (a) allows the passage of solutions for processing said element when said element is contacted with an external processing bath and (b) blocks the diffusion out of said element of the diffusible dye formed from said solid particle dispersion of a diffusible-dye forming compound when said element is contacted with an external processing bath, and wherein the size of dye forming compound particles in said solid particle dispersion of a diffusible-dye forming compound is on average less than 1 μm in largest dimension and wherein the physical state of the dye forming compound in said particles is a microcrystalline physical state.

2. A photographic color diffusion transfer element comprising one and only one dimensionally stable support, wherein said support is optically transparent, and coated thereon in reactive association and in sequence (1) a mordant layer for binding diffusible dyes, (2) an opacifying light reflecting layer, (3) one or more layers comprising radiation sensitive silver halide, a solid particle dispersion of a diffusible-dye forming compound, or radiation sensitive silver halide and a solid particle dispersion of a diffusible-dye forming compound, and (4) a barrier layer comprising a polymer that (a) allows the passage of solutions for processing said element when said element: is contacted with an external processing bath and (b) blocks the diffusion out of said element of the diffusible dye formed from said solid particle dispersion of a diffusible-dye forming compound when said element is contacted with an external processing bath, and wherein the size of dye forming compound particles in said solid particle dispersion of a diffusible-dye forming compound is on average less than 1 μm in largest dimension and wherein the physical state of the dye forming compound in said particles is a microcrystalline physical state.

3. A photographic color diffusion transfer element comprising one and only one dimensionally stable support, wherein said support is optically transparent, and coated thereon in reactive association and in sequence (1) one or more layers comprising radiation sensitive silver halide, a solid particle dispersion of a diffusible-dye forming compound, or radiation sensitive silver halide and a solid particle dispersion of a diffusible-dye forming compound, (2) an opacifying light reflecting layer, (3) a mordant layer for binding diffusible dyes, and (4) a barrier layer comprising a polymer that (a) allows the passage of solutions for processing said element when said element is contacted with an external processing bath and (b) blocks the diffusion out of said element of the diffusible dye formed from said solid particle dispersion of a diffusible-dye forming compound when said element is contacted with an external processing bath, and wherein the size of dye forming compound particles in said solid particle dispersion of a diffusible-dye forming compound is on average less than. 1 μm in largest dimension and wherein the physical state of the dye forming compound in said particles is a microcrystalline physical state.

4. An element as in claims 1, 2, or 3, wherein said silver halide comprises greater than 95 mole percent silver chloride.

5. An element as in claims 1, 2, or 3, wherein one or more interlayers of any type are adjacent to any of said layers (1), (2), (3), and (4), and wherein said interlayers are permeable to aqueous alkaline processing solution.

6. An element as in claims 1, 2, or 3, wherein said diffusible-dye forming compound of said solid particle dispersion reacts with the oxidation product of a p-phenylenediamine or p-aminophenol color developing agent to form diffusible dye.

7. An element as in claims 1, 2, or 3, wherein said diffusible dye comprises at least one solubilizing group having $pK_a$ in the range of 4 to 10.

8. An element as in claims 1, 2, or 3, wherein said diffusible dye comprises at least one solubilizing group having $pK_a$ in the range of 4.5 to 6.5.

9. An element as in claims 1, 2, or 3, wherein said diffusible dye comprises at least one —COOH solubilizing group.

10. An element as described in claims 1, 2, or 3, wherein said external bath comprises a volume greater than 200 mL per square meter of element contacting said bath.

11. An element as described in claims 1, 2, or 3, wherein said mordant layer comprises polymer comprising vinyl repeat units having tertiary amino groups or quaternary ammonium groups and wherein said vinyl repeat units are selected from the group consisting of:

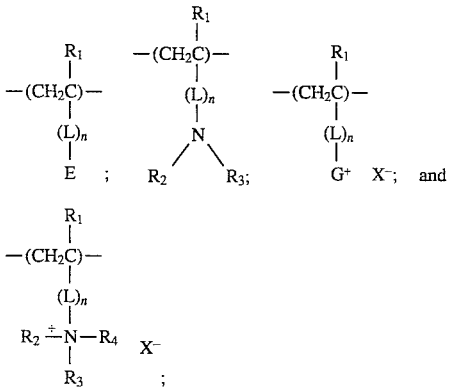

wherein $R_1$ is a hydrogen atom or a lower alkyl group having 1 to 6 carbon atoms; L represents a divalent linking group having 1 to 20 carbon atoms; E represents a hetero ring containing a carbon-nitrogen double bond; n is 0 or 1; $R_2$, $R_3$, and $R_4$ are the same or different and each represents an alkyl group having 1 to 12 carbon atoms or an aralkyl group having 7 to 20 carbon atoms; $G^+$ represents a hetero ring which is quaternized and contains a carbon-nitrogen double bond; $X^-$ represents a monovalent anion; and $R_2$ and $R_3$, $R_3$ and $R_4$, or $R_2$ and $R_4$ may form, together with the adjacent nitrogen atom, a cyclic structure.

12. An element as described in claims 1, 2, or 3, wherein the barrier layer comprises a polymer containing from about $1\times10^{-5}$ to about $4\times10^{-3}$ moles/gram of ion-forming functional groups.

13. An element as described in claim 12, wherein the polymer is comprised of repeating units derived from ethylenically unsaturated monomers.

14. An element as described in claim 13, wherein the polymer is comprised of repeating units derived from a hydrophobic acrylate, methacrylate, acrylamide or methacrylamide monomer.

15. An element as described in claim 14, wherein the polymer is further comprised of repeating units derived from a nonionic hydrophilic ethylenically unsaturated monomer.

16. An element as described in claim 14, wherein the polymer comprises repeating units of the formula $$-(A)_m-(B)_n-$$

wherein the repeating unit A derives from a hydrophobic monomer having the structure

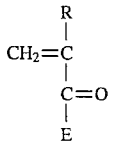

where

R is hydrogen or methyl;

E is $-OR_2$ or $-NR_3R_4$ $R_2$ is a substituted or unsubstituted straight, branched, or cyclic alkyl or aryl group of about 1 to 10 carbon atoms;

$R_3$ and $R_4$ are independently selected from hydrogen or any $R_2$ group; and $R_3$ and $R_4$ together contain at least 3 carbon atoms;

m is 0 to 99.5 mole percent;

wherein the repeating unit B derives from an ionic hydrophilic monomer having the structure

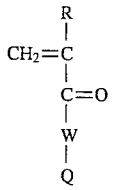

where

R is hydrogen or methyl;

W is $-OR_5$ or $-NR_6R_7$;

$R_5$ is a straight, branched, or cyclic alkylene or arylene group of 1 to about 10 carbon atoms;

$R_6$ is hydrogen or a straight, branched, or cyclic alkyl or aryl group from 1 to about 6 carbon atoms;

$R_7$ is a straight, branched or cyclic alkylene or arylene group of 1 to about 10 carbon atoms;

n is 0.5 to 100 mole percent;

Q is an ionic functional group independently selected from:

(a) $—NH_2$ or the acid addition salt $—NH_2{:}HX$, where X is an appropriate acid anion or (b) $—CO_2M$, $—SO_2M$, $—OSO_3M$, $—OPO_3M$ and —OM where M is an appropriate cation;

and wherein the polymer contains from about $1\times10^{-5}$ to about $4\times10^{-3}$ moles/gram of ion forming functional groups.

17. An element as described in claims 1, 2, or 3, wherein the barrier layer comprises a polymer coated at a level of 750 $mg/m^2$ to 2 $g/m^2$.

18. A diffusion transfer process for forming a color photographic image comprising the steps of:

(a) providing an integral element comprising one and only one dimensionally stable layer comprising a coating support, and coated thereon in reactive association (1) a mordant layer for binding diffusible dyes, (2) one or more layers comprising radiation sensitive silver halide, a solid particle dispersion of a diffusible-dye forming compound, or radiation sensitive silver halide and a solid particle dispersion of a diffusible-dye forming compound, and (3) a barrier layer comprising a polymer that (i) allows the passage of solutions for processing said element when said element is contacted with an external processing bath and (ii) blocks the diffusion out of said element of the diffusible dye formed from said solid particle dispersion of a diffusible-dye forming compound when said element is contacted with an external processing bath;

(b) exposing said element to actinic radiation (c) processing said element by contacting said element to an external processing bath containing compounds selected from the group consisting of color developer compounds of the primary amine type, compounds which activate the release of incorporated color developers, and compounds which activate development by incorporated dye developers; and (d) washing said element to remove compounds imbibed in step (c)i wherein the size of dye forming compound particles in said solid particle dispersion of a diffusible-dye forming compound is on an average less than 1μm in largest dimension and wherein the physical state of the dye forming compound in said particles is a microcrystalline physical state.

19. A process as in claim 18, wherein said support comprises an opaque and light reflecting layer, wherein said layers (1), (2), and (3) are coated in sequence upon said support, and wherein a stripping layer is coated between layers (1) and (2),

20. A process as in claim 18, wherein said support comprises an optically transparent layer, wherein said layers (1), (2), and (3) are coated in sequence upon said support and wherein an opacifying light reflecting layer is coated between layers (1) and (2).

21. A process as in claim 18, wherein said support comprises an optically transparent layer, wherein said layers (2), (1), and (3) are coated in sequence upon said support, and wherein an opacifying light reflecting layer is coated between layers (2) and (1).

22. A process as in claims 19, 20, or 21, wherein said silver halide comprises greater than 95 mole percent silver chloride.

23. A process as described in claims 19, 20, or 21, wherein said external bath comprises a volume greater than 200 mL per square meter of element contacting said bath.

24. A process as described in claims 19, 20, or 21, wherein said mordant comprises polymer comprising vinyl repeat units having tertiary amino groups or quaternary ammonium groups and wherein said vinyl repeat units are selected from the group consisting of:

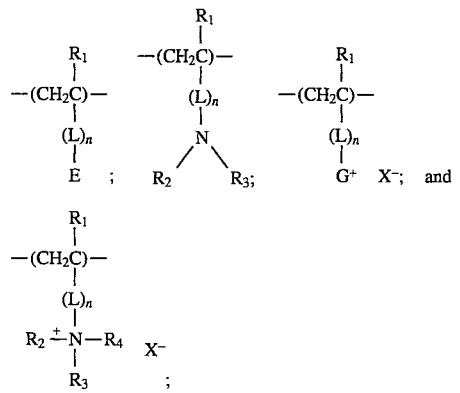

wherein $R_1$ is a hydrogen atom or a lower alkyl group having 1 to 6 carbon atoms; L represents a divalent linking group having 1 to 20 carbon atoms; E represents a hetero ring containing a carbon-nitrogen double bond; n is 0 or 1; $R_2$, $R_3$, and $R_4$ are the same or different and each represents an alkyl group having 1 to 12 carbon atoms or an aralkyl group having 7 to 20 carbon atoms; $G^+$ represents a hetero ring which is quaternized and contains a carbon-nitrogen double bond; $X^-$ represents a monovalent anion; and $R_2$ and $R_3$, $R_3$ and $R_4$, or $R_2$ and $R_4$ may form, together with the adjacent nitrogen atom, a cyclic structure.

25. A process as described in claims 19, 20, or 21, wherein the barrier layer comprises a polymer containing from about $1\times10^{-5}$ to about $4\times10^{-3}$ moles/gram of ion forming functional groups such that the barrier layer reflects diffusible dye and allows the passage of processing solutions for processing the silver halide emulsion layer.

26. A process as in claims 19, 20, or 21, wherein one or more interlayers of any type are adjacent to any of said layers (1), (2), and (3), and wherein said interlayers are permeable to aqueous alkaline processing solution.

27. An element as described in claims 1, 2, or 3, wherein the barrier layer comprises a polymer containing from about $5\times10^{-5}$ to about $2\times10^{-3}$ moles/gram of ion-forming functional groups.

28. A process as described in claims 19, 20, or 21, wherein the barrier layer comprises a polymer containing from about $5\times10^{-5}$ to about $2\times10^{-3}$ moles/gram of ion forming functional groups such that the barrier layer reflects diffusible dye and allows the passage of processing solutions for processing the silver halide emulsion layer.

* * * * *